US005145305A

United States Patent [19]

Green

[11] Patent Number: 5,145,305

[45] Date of Patent: Sep. 8, 1992

[54] COLLECTION VEHICLE, APPARATUS FOR USE IN THE VEHICLE AND METHOD OF COLLECTING MATERIAL

[75] Inventor: Peter Green, Worcester, United Kingdom

[73] Assignee: Waste Hoists Limited, United Kingdom

[21] Appl. No.: 595,089

[22] Filed: Oct. 10, 1990

[30] Foreign Application Priority Data

Oct. 18, 1989 [GB] United Kingdom ..... 8923501

[51] Int. Cl.[5] ..... B65F 3/04

[52] U.S. Cl. ..... 414/406; 60/494; 414/409; 414/420; 414/786

[58] Field of Search ..... 414/406–409, 414/419–421, 303, 425, 786, 546, 555; 60/494

[56] References Cited

U.S. PATENT DOCUMENTS

| | | | |
|---|---|---|---|
| 3,827,587 | 8/1974 | Liberman et al. | 414/420 |
| 4,057,156 | 11/1977 | Thompson et al. | 414/408 |
| 4,305,693 | 12/1981 | Naab | 414/408 X |
| 4,566,840 | 1/1986 | Smith | 414/408 |
| 4,687,405 | 8/1987 | Olney | 414/408 |
| 4,722,656 | 2/1988 | Naab | 414/421 X |
| 4,850,787 | 7/1989 | Yoneda | 414/555 X |
| 4,978,268 | 12/1990 | Winwood et al. | 414/409 |
| 4,986,075 | 1/1991 | Shimoie | 60/494 X |
| 5,004,392 | 4/1991 | Naab | 414/303 X |
| 5,062,759 | 11/1991 | Pieperhoff | 414/406 X |
| 5,064,333 | 11/1991 | Würtz | 414/409 |

FOREIGN PATENT DOCUMENTS

| | | |
|---|---|---|
| 0010719 | 3/1983 | European Pat. Off. . |
| 2078196 | 1/1982 | United Kingdom . |
| 2128578 | 5/1984 | United Kingdom . |
| 88242664 | 10/1988 | United Kingdom . |

*Primary Examiner*—David A. Bucci

*Attorney, Agent, or Firm*—Marshall, O'Toole, Gerstein, Murray & Bicknell

[57] ABSTRACT

A refuse collection vehicle has a pair of hoists which can be operated together to lift a large container by both hoists and which can also be operated separately for the lifting of a small container by each hoist, a hydraulic liquid circuit which includes a respective control valve for each hoist, respective inlets on the control valves are interconnected by a duct which includes a flow-restrictor to permit hydraulic liquid flow to one control valve to be supplemented at a relatively low rate from hydraulic liquid flow to the other control valve, so that to operate the hoists together both control valves are operated together.

8 Claims, 3 Drawing Sheets

COLLECTION VEHICLE, APPARATUS FOR USE IN THE VEHICLE AND METHOD OF COLLECTING MATERIAL

BACKGROUND TO THE INVENTION

From one aspect, the present invention relates to a collection vehicle having a load-receiving body and a pair of hoists mounted on the vehicle for raising from the ground respective containers and tipping the raised containers to discharge the contents thereof into the load-receiving body. Vehicles of this kind are commonly used for the collection of refuse from domestic and other premises.

There has been recognized for some years the need to operate each of a pair of hoists on a refuse collection vehicle independently of the other hoist, for emptying the contents of smaller bins, and the need to use the two hoists together to raise a larger bin and empty the contents thereof into the load-receiving body of the vehicle. Various arrangements have been proposed for ensuring that the two hoists move together when they are required to raise a larger bin and for permitting the two hoists to move relative to each other when either hoist is to be used alone to raise a smaller bin or both hoists are to be used independently to raise respective smaller bins.

SUMMARY OF THE INVENTION

According to the first aspect of the invention, there is provided a collection vehicle having a load-receiving body and a pair of hoists mounted on the vehicle for raising from the ground respective containers and tipping the raised containers to discharge the contents thereof into the load-receiving body, wherein each hoist includes at least one hydraulic fluid-operated actuating device for actuating the hoist, the vehicle includes supply means for supplying hydraulic fluid under pressure to said devices, there is provided for each hoist a respective control valve for controlling the supply of hydraulic fluid to the actuating device of that hoist, each control valve having an inlet duct for leading hydraulic fluid under pressure to the control valve, and wherein the respective inlet ducts are inter-connected via a flow restrictor which provides for flow of hydraulic fluid from either inlet duct to the other inlet duct, said flow being restricted to a rate which is small, relative to the rate of supply of hydraulic fluid to each actuating device through the associated control valve.

The hoists of a vehicle according to the first aspect of the invention may be operated alternately for emptying respective containers independently. When one control valve is opened to direct hydraulic fluid to the associated actuating device, there may be diversion of hydraulic fluid flow, at a relatively low rate, from the inlet duct of the open control valve via the other control valve to a reservoir. Such diversion of fluid will affect the speed at which the hoist being operated raises a container but will not prevent raising of that container. The required speed of operation of a hoist can be attained by selecting appropriate supply means and flow-restricting means for incorporation in the hydraulic circuit of the vehicle.

The hoists of a vehicle according to the first aspect of the invention may alternatively be operated at the same time for emptying the contents of respective containers. In this case, there may be some diversion of hydraulic fluid, at a relatively low rate, from the inlet duct of one control valve to the inlet duct of the other control valve. The consequence of this may be a small difference in the speed at which the two hoists raise their respective containers but such diversion will not prevent either container from being raised and emptied. Furthermore, the hydraulic circuit may remain the same as the circuit used for operating the hoists alternately, the difference being that, to operate the hoists at the same time, both control valves are open at the same time; whereas to operate the hoists alternately, the control valves are opened alternately.

The hoists of a vehicle according to the first aspect of the invention may alternately be operated together, by opening both of the control valves, for raising a larger container which is carried partly by one hoist and partly by the other hoist. The hydraulic circuit may remain the same as when the hoists are operated alternately. We have discovered that, by providing for diversion of hydraulic fluid at a relatively low rate from one inlet duct to the other, movement of the two hoists substantially together is achieved without the use of a change-over valve additional to the control valves.

According to a second aspect of the invention, there is provided apparatus for mounting on a vehicle for use in raising containers from the ground and tipping the containers to discharge contents of the containers into a load-receiving body of the vehicle, which apparatus comprises a pair of hoists, each hoist including at least one hydraulic fluid-operated actuating device for actuating the hoist, a pair of control valves for controlling the supply of hydraulic fluid to respective ones of the actuating devices, respective inlet ducts for leading hydraulic fluid under pressure to the control valves and an interconnecting duct for connecting the inlet ducts with each other, the interconnecting duct including a flow restrictor which provides for flow of hydraulic fluid from either inlet duct to the other at a rate which is small, relative to the rate at which hydraulic fluid can be supplied to each actuating device through the associated control valve.

According to a third aspect of the invention, there is provided a method of collecting material from a plurality of containers which includes at least one smaller container and at least one larger container, wherein there is provided a vehicle having a load-receiving body, there is mounted on the vehicle a pair of hoists, each hoist including a respective hydraulic fluid-operated actuating device, supply means for supplying hydraulic fluid under pressure to the actuating devices and a pair of control valves, one for each hoist, arranged for controlling the supply of hydraulic fluid to the actuating devices, wherein one of the smaller containers is mounted on one of the hoists, the control valve associated with that hoist is opened to direct hydraulic fluid from the supply means to the actuating device of that hoist to raise the smaller container, the control valve is subsequently operated to reverse movement of the container until the smaller container is lowered to the ground, the larger container is mounted on the two hoists together, the control valves are both opened to direct hydraulic fluid to the actuating devices of both hoists to raise the larger container, the control valves are subsequently both operated to reverse movement of the larger container until the larger container is lowered to the ground and wherein, whilst the control valves are both open and hydraulic fluid is being supplied at a relatively high rate via each control valve to the corresponding actuating device, the flow to one control valve is allowed to be supplemented at a relatively low rate from the flow to the other control valve.

We have discovered that, when both control valves are opened to raise a larger bin carried on both hoists, any initial tendency of one hoist to raise the container more rapidly than does the other hoist is compensated for automatically by supplementing of the flow to one control valve, at the expense of the flow to the other conrol valve. We have found that it is unnecessary to use a change-over valve to change the hydraulic circuit, for example by separating one part of the circuit from another part, in preparation for operation of the two hoists together to raise a larger container.

BRIEF DESCRIPTION OF THE DRAWINGS

A collection vehicle embodying the first and second aspects of the invention and which is used in a method according to the third aspect will now be described, with reference to the accompanying drawings, wherein.

DETAILED DESCRIPTION

Figure 1:
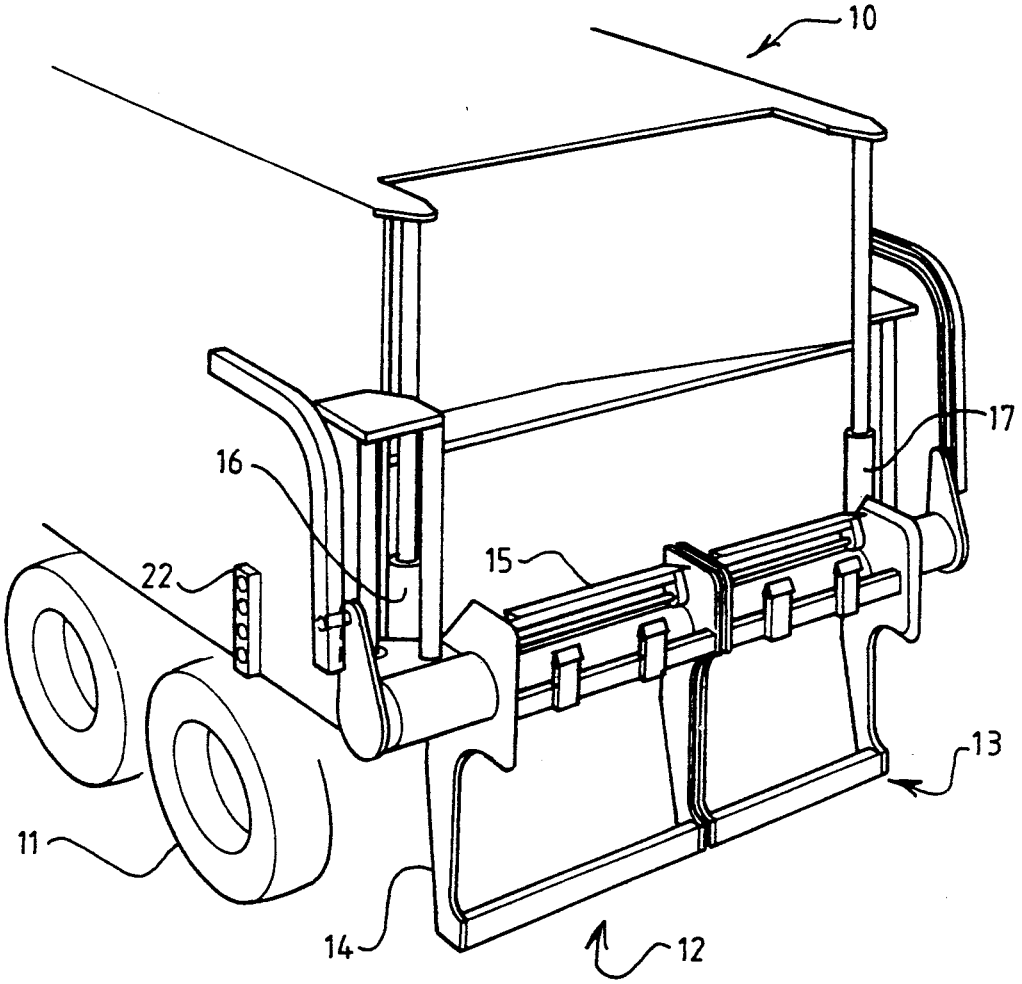
FIG. 1 shows a perspective view of a rear part of the vehicle, including a pair of hoists.

The vehicle shown in FIG. 1 includes a load carrying body 10 mounted on a chassis (not shown) which is supported by running wheels, one of which is shown at 11. The vehicle also has a cab (not shown) for a driver and other operators of the vehicle. At the rear end of the body 10, there is provided a tailgate incorporating a hopper for receiving refuse and a packer mechanism for moving refuse from the hopper into a collecting chamber of the body. The vehicle is constructed and arranged generally in a known manner. As is known, provision is made for raising the tailgate to permit refuse which has been collected in the body 10 to be discharged therefrom.

A pair of bin hoists 12 and 13 is mounted on the body 10 adjacent to and to the rear of the tailgate. Each hoist may be generally as described and illustrated in UK Patent Application No. 8824266.4 filed Oct. 17, 1988. Thus, the hoist 12 includes a bin carrier 14 having supports for engaging beneath the lip of a bin and clamping means 15 for holding the lip of the bin in engagement with the supports. The hoist 12 further comprises a hydraulic ram 16 for raising the bin carrier 14 relative to the body 10 and tipping the bin carrier to discharge into the hopper the contents of a bin carried on the bin carrier. The hoist 13 shown in FIG. 1 is arranged in a corresponding manner and includes a hydraulic ram 17.

Alternative hoists may be substituted for the hoist illustrated in FIG. 1. Each such hoist will include at least one fluid-operated actuating device. The actuating device may be a ram as shown in FIG. 1 or may be some other kind of hydraulic motor. Furthermore, each hoist may comprise more than a single actuating device. For example, the hoist may include a ram for raising the bin carrier and a rotary actuator for tipping the bin carrier. Other examples of suitable vehicles and hoists are disclosed in GB-2,078,196, EP-10719 and GB-2,128,578.

Figure 2:
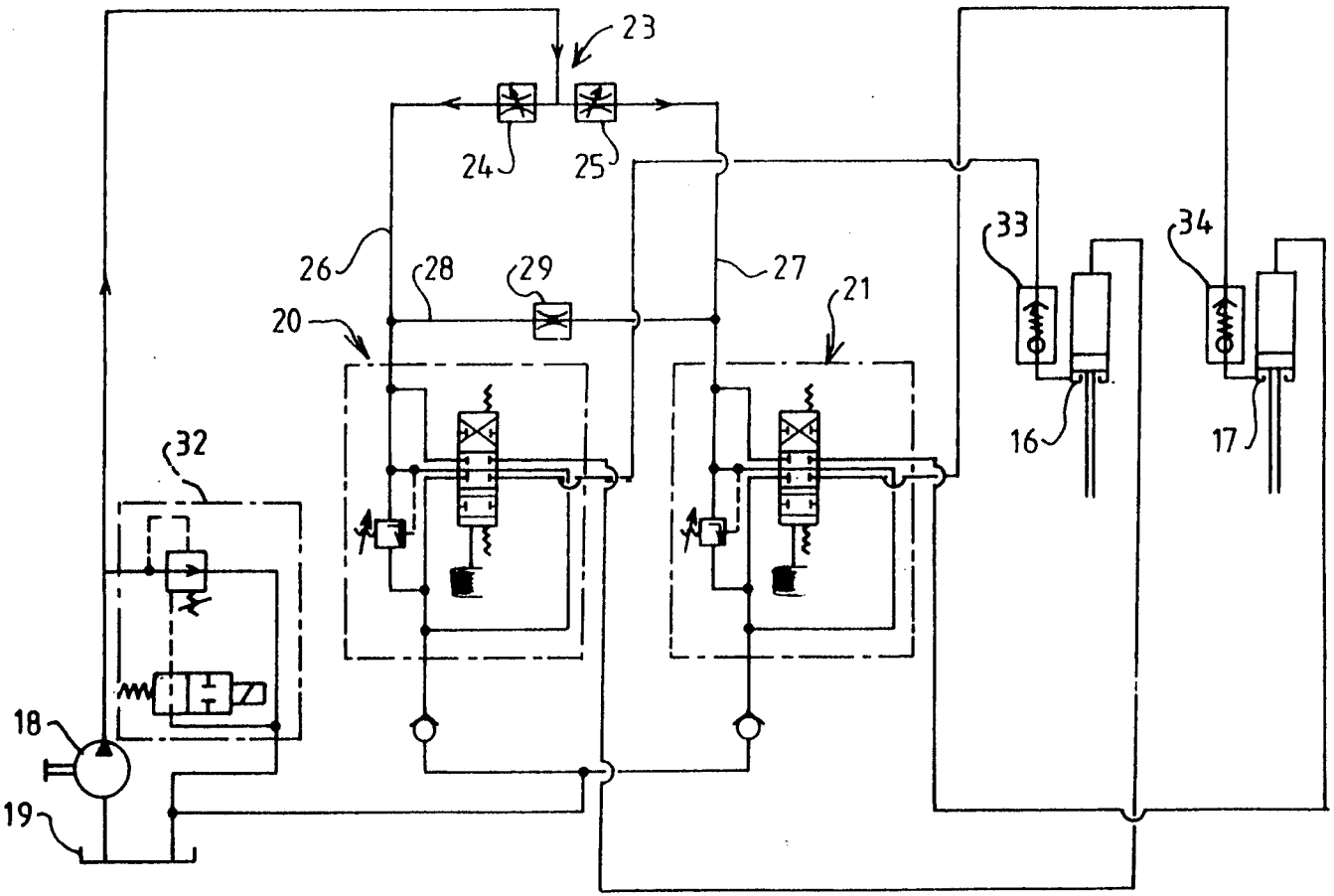
FIG. 2 shows diagrammatically a hydraulic circuit of the vehicle.

The rams 16 and 17 are connected in the hydraulic circuit represented in FIG. 2. This circuit further comprises a hydraulic pump 18 drivingly connected with an engine of the vehicle. The arrangement may be such that the pump is driven continuously, whilst the vehicle engine is running. The pump has an inlet which communicates with a hydraulic reservoir 19 on the vehicle. The hydraulic circuit further comprises control valves 20 and 21 for controlling the flow of hydraulic fluid from the pump 18 to the rams 16 and 17 respectively.

It will be seen from FIG. 2 that the hydraulic circuit is devoid of ducts arranged for leading hydraulic fluid under pressure downstream from either control valve to the actuating means of both hoists.

The particular control valves represented in FIG. 2 are operated electrically. Each control valve comprises a respective spool which is connected mechanically with the core of a solenoid associated with the valve. The valve includes springs for biasing the spool to a closed position represented in FIG. 2. The core of the solenoid may be permanently magnetized, so that energization of the associated winding by means of direct current flowing in one direction can be used to drive the spool in a first direction and energization of the winding by direct current flowing in the opposite direction can be used to drive the spool in the opposite direction. Alternatively, two solenoids may be associated with each spool, one for driving the spool in its first direction from its closed position and the other for driving the spool in a second direction from its closed position.

Input means is provided to enable the operators of the vehicle to apply to an electrical circuit of the vehicle instructions for energization of the solenoids. The input means associated with the hoist 12 is represented at 22 in FIG. 1 and comprises four push buttons, a first button for use in driving the spool of the valve 20 in a first direction, the second button for use in driving the spool of the valve 20 in a second direction, the third button for use in driving the spools of both valves in the first direction and the fourth button for driving the spools of both valves in the second direction. A corresponding input means (not shown) is provided at the opposite side of the vehicle, adjacent to the hoist 13. This further input means can be used either to operate the hoist 13 alone or to operate both the hoists together.

The hydraulic circuit shown in FIG. 2 includes flow-dividing means 23 connected with the outlet from the pump 18 and arranged to divide the flow from the pump into two parts, one part being directed to the control valve 20 and the other part to the control valve 21. The flow dividing means includes known flow limiting devices 24 and 25 leading to respective inlet ducts 26 and 27 which are connected respectively to the inlets of the control valves 20 and 21. The flow limiting devices 24 and 25 limit the rate at which hydraulic fluid can flow from the pump to either control valve. This control is substantially independent of the pressure in the hydraulic fluid at various positions in the hydraulic circuit and the flow limiting devices may be adjustable so that a selected maximum flow rate can be established for each control valve. The hydraulic circuit further comprises an interconnecting duct 28 which includes a flow restrictor 29 and interconnects the inlet ducts 26 and 27 downstream of the flow limiting devices 24 and 25 but upstream of the control valves 20 and 21. The flow restrictor 29 is arranged to limit the flow along the interconnecting duct 28 to a maximum value which is small, as compared with the maximum flow rate through each of the flow limiting devices 24 and 25. Hydraulic fluid can flow in either direction along the interconnecting duct 28.

The flow restrictor 29 is preferably arranged to limit the flow along the interconnecting duct 28 to a value which is no more than one half of the flow rate through either of the flow limiting devices 24 and 25, when subjected to the same differential pressure. The flow restrictor could be arranged to limit the flow along the duct 28 to a value of only one tenth the flow rate through each of the flow limiting devices 24 and 25 at the same differential pressure. In one example, the rate of flow through each of the flow limiting devices 24 and 25, when these are subjected to a differential pressure in the region of 800 psi is approximately seven liter per minute. The rate of flow through the restrictor 29, when subjected to a similar differential pressure, is in the region of 2.5 to 3.5 liters per minute. The diameter of the orifice defined by the flow restrictor 29 is selected according to the sizes of the other components of the hydraulic circuit and is typically one millimeter.

When neither hoist is in use but the vehicle engine is running, the control valves 20 and 21 both permit flow of hydraulic fluid from the pump 18 to the reservoir 19. The hydraulic circuit is preferably so arranged that, under those conditions, the rate of flow through one control valve will be the same as the rate of flow through the other control valve. Flow of hydraulic fluid to and from the rams 16 and 17 is prevented by the control valves, so that the bin carriers of the hoists are held against movement relative to the vehicle body 10. If the contents of a single, smaller bin are to be emptied into the vehicle body 10, that bin is positioned on the ground adjacent to the bin carrier of the hoist 12 and the appropriate button of the input means 22 is pressed to cause the valve 20 to open to direct hydraulic fluid under pressure from the pump 18 to the ram 16 so that the hoist 12 is operated to raise the bin from the ground and then to tip the bin over the hopper and discharge the contents from the bin. Operation of the valve 20 in this way stops the flow of hydraulic fluid through that valve directly to the reservoir 19 and the pressure in the inlet duct 26 rises relative to the pressure in the inlet duct 27. This promotes flow of hydraulic fluid at a relatively low rate through the inter-connecting duct 28 to the control valve 21 and thence to the reservoir. Accordingly, a small proportion of the hydraulic fluid which flows through the flow limiting device 24 is diverted away from the valve 20 and ram 16 to the reservoir. The flow limiting device 24 is selected or adjusted to provide raising of a bin by the hoist 12 at the required speed.

Alternatively, the hoist 13 may be used in a corresponding manner to raise a single, smaller bin and empty the contents thereof into the hopper of the vehicle. In this case, there would be flow at a relatively low rate through the inter-connecting duct 28 from the flow limiting device 25 to the control valve 20 and thence to the reservoir.

When the bin is to be lowered, the appropriate push button of the input means 22 is pressed to cause the shuttle of the valve 20 to be moved through its closed position to a vent position. In this position, the shuttle permits hydraulic fluid to drain from the ram 16 to the reservoir 19 so that the bin is returned to the ground.

Signalling means, for example a limit switch, may be provided to generate a signal indicating that the hoist 12 has returned to its lowered position. This signal may be used to terminate energization of the solenoids associated with the valve 20 and permit the spool of the valve to return to its closed position.

The valve 21 is operated in a similar way to permit the hoist 13 to return to its lowered position and then to close the valve to prevent further movement of the hoist.

The hoists 12 and 13 may be used concurrently to raise respective smaller bins from the ground. In this case, one operator would press the appropriate push button of the input means 22 to open the control valve 20 and direct hydraulic fluid under pressure from the pump 18 to the ram 16. Another operator would press the appropriate push button of the input means associated with the hoist 13 to open the control valve 21 and direct hydraulic fluid under pressure from the pump 18 to the ram 17. If the push buttons are pressed at exactly the same moment and the hoists operate at exactly the same speed, then there will be no flow through the inter-connecting duct 28. If one push bottom is pressed before the other and/or if one hoist operates somewhat more slowly than does the other, for example because it bears a heavier load, then there will be flow at a relatively low rate through the inter-connecting duct 28. Such diversion of hydraulic fluid does not prevent operation of either hoist at a speed which is approximately the same as the speed at which that hoist would operate when the other hoist is not being operated.

The hoists 12 and 13 may be operated together to raise a larger bin. In preparation for this, the larger bin would be moved into a position at the rear of the vehicle and immediately adjacent to the bin carriers of both hoists so that corresponding formations on these bin carriers can be engaged beneath a lip of the bin. The appropriate push button on either of the input means is then pressed to instruct the electrical circuit of the vehicle to energize the relays associated with both of the valves 20 and 21 to open both valves for directing hydraulic fluid under pressure from the pump 18 to both of the rams 16 and 17. Opening of the valves would take place at substantially the same instant. The hydraulic circuit is arranged to supply hydraulic fluid at the same rate through the valves 20 and 21. Thus, for example, the flow limiting devices 24 and 25 would normally be substantially identical and, if adjustable, adjusted to provide the same flow rates. However, there may be some degree of interference with operation of one of the hoists. For example, if the larger bin is not level with the vehicle body, then a load may be imposed on the bin carrier of the hoist 12 slightly before the load is imposed on the bin carrier of the hoist 13. Furthermore, the load in the bin may be unevenly distributed. Such circumstances may disturb the balanced flow rate so that, briefly, the rate of flow to one of the rams 16 and 17 exceeds the rate of flow to the other ram. In this event, flow takes place at a relatively low rate through the inter-connecting duct 28 in a direction such that the required relation between the bin carriers of the hoists 12 and 13 is restored and the bin carriers are then moved together.

It will be noted that no valves, other than the control valves 20 and 21, are used to set the hydraulic circuit either in a condition for operation of the hoists 12 and 13 together or to set the hydraulic circuit in a condition for operation of these hoists separately. The circuit illustrated in FIG. 2 is a relatively simple and inexpensive circuit.

Whilst we prefer to provide control valves 20 and 21 which are operated electrically, it would be within the scope of the invention to provide known pneumatically operated control valves, in the case of a vehicle on which there is available a supply of compressed air. In the case where pneumatically operated control valves are provided, the input means may comprise suitable valves for directing air under pressure to the control valves. Alternatively, the input means may comprise push buttons or the like operating electrical switches which, in turn, control pneumatic valves for directing air under pressure to the control valves.

The circuit of FIG. 2 further comprises an emergency valve arrangement 32 for diverting the output from the pump 18 to the reservoir 19 when an electrical signal is provided to the valve arrangement 32 by operation of an emergency switch on the vehicle. The valve arrangement 32 also limits the pressure which can be produced in the circuit of FIG. 2 by the pump 18. Such valve arrangements are well known and commonly provided in refuse-collection vehicles.

FIG. 2 also shows safety valves 33 and 34 associated with the rams 16 and 17 respectively. These safety valves are normally held open by respective springs to permit hydraulic fluid under pressure to flow to the associated ram. In the event of an abrupt loss of pressure in a line which conveys hydraulic fluid under pressure to the ram, whilst the associated bin carrier is out of its lowered position, the sudden flow of hydraulic fluid along that line from the ram causes the safety valve to close, thereby avoiding sudden descent of the bin carrier. The provision of such safety valves is usual in refuse collection vehicles.

Figure 3:
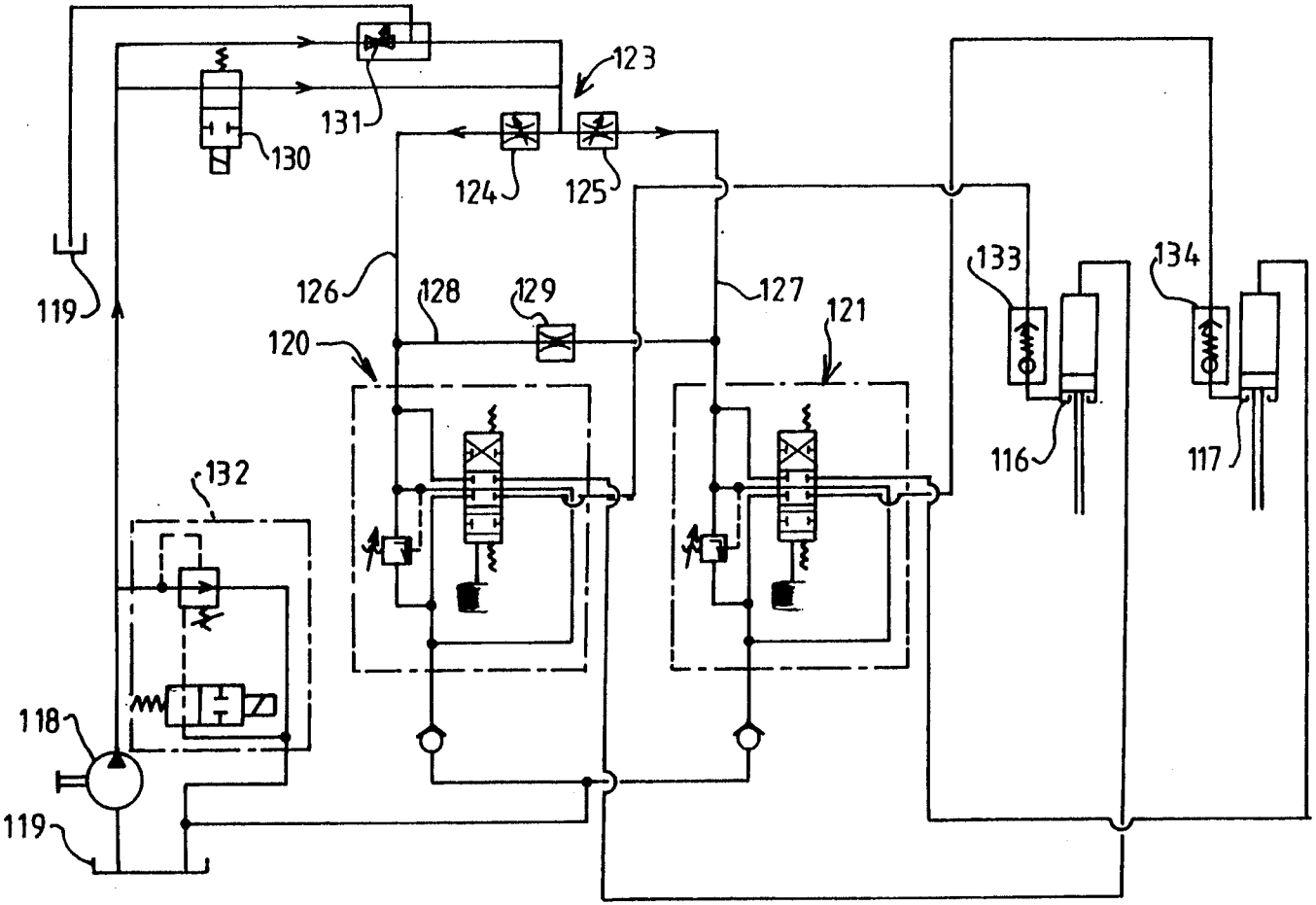
FIG. 3 shows diagrammatically a modified hydraulic circuit of the vehicle.

Using the circuit of FIG. 2, a larger bin will be raised at approximately the same rate as a smaller bin would be raised by a single hoist. In some circumstances, it is preferable to raise larger bins more slowly than smaller bins are raised. To meet this requirement, the circuit of FIG. 2 may be adapted as shown in FIG. 3. In FIG. 3, parts corresponding to those hereinbefore described with reference to FIG. 2 are identified by like reference numerals with the prefix 1 and the preceding description is deemed to apply to those corresponding parts.

The outlet of the pump 118 is connected with the flow-divider 123 via a valve 130 and a flow-limiting device 131 which is connected in parallel with the valve 130. Normally, the valve 130 is open and does not affect significantly flow of hydraulic fluid from the pump to the flow-divider 123. When operation of the hoists at a lower rate is required, the valve 130 is closed. This may be achieved manually or by means of a solenoid connected with the valve. Flow of hydraulic fluid from the pump to the flow-divider is then diverted to the device 131. This device is selected or adjusted to provide the required flow rate, corresponding to the required speed of operation of the hoists, for example when raising a single, larger bin. It will be understood that additional or alternative flow-limiting devices may be incorporated in the circuit to achieve required speeds of operation under certain circumstances or under all circumstances.

I claim:

1. A collection vehicle having a load-receiving body and a pair of hoists mounted on the vehicle for raising respective containers and tipping the raised containers to discharge any contents thereof into the load-receiving body, wherein each hoist includes at least one hydraulic fluid-operated actuating device for actuating the hoist, the vehicle includes supply means for supplying hydraulic fluid under pressure to said actuating devices, there is provided for each hoist a respective control valve for controlling the supply of hydraulic fluid from the hydraulic fluid supply means to the actuating device of the hoist, each control valve having an inlet duct for leading hydraulic fluid under pressure to the control valve, and wherein the respective inlet ducts of the control valves are interconnected via a flow restrictor which provides for flow of hydraulic fluid from either inlet duct to the other inlet duct, said flow being restricted to a rate which is small, relative to a rate of supply of hydraulic fluid to each actuating device through a control valve which controls the hydraulic fluid supply to a respective actuating device.

2. A vehicle according to claim 1 further comprising a pair of flow-limiting devices connected with respective ones of the inlet ducts at upstream ends thereof for limiting the flow rates along each inlet duct from the corresponding flow-limiting device to an associated control valve substantially to a maximum value for one of the flow-limiting devices and to the same maximum value for the other of the flow-limiting devices.

3. A vehicle according to claim 1 which is devoid of ducts arranged for leading hydraulic fluid under pressure downstream from either control valve to the actuating device of both hoists.

4. A vehicle according to claim 1 in which each control valve controls only one of the two actuating devices.

5. Apparatus suitable for mounting on a vehicle for use in raising containers and tipping the containers to discharge any contents thereof into a load-receiving body of the vehicle, which apparatus comprises a pair of hoists, each including at least one fluid-operated actuating device for actuating the hoist and a pair of control valves for controlling the supply of hydraulic fluid under pressure to respective ones of the actuating devices, each control valve having an inlet duct for leading hydraulic fluid under pressure to the control valve and an interconnecting duct for connecting the inlet ducts to each other, the interconnecting duct being adapted to provide for flow of hydraulic fluid from either inlet duct to the other inlet duct but being adapted to restrict said flow to a rate which is small, relative to the rate at which flow is permitted through each control valve to the associated actuating device.

6. A collection vehicle having a load-receiving body and first and second hoists mounted on the vehicle for raising respective containers and tipping the raised containers to discharge any contents therein into the load-receiving body, wherein each hoist includes at least one hydraulic fluid-operated actuating device for actuating the hoist, the vehicle includes supply means for supplying hydraulic fluid under pressure to said actuating devices, there is provided for the first hoist a first control valve for controlling the supply of hydraulic fluid to the actuating device of the first hoist, there is provided for the second hoist a second control valve for controlling the supply of hydraulic fluid to the actuating device of the second hoist, each control valve having an inlet duct for leading hydraulic fluid under pressure to the control valve, wherein the respective inlet ducts are interconnected via a flow restrictor which provides for flow of hydraulic fluid from either inlet duct to the other inlet duct, said flow being restricted to a rate which is small, relative to a rate of supply of hydraulic fluid to each actuating device through an associated control valve, wherein there is no duct leading other than via the flow restrictor from the first control valve to the actuating device of the second hoist and there is no duct leading other than via the flow restrictor from the second control valve to the actuating device of the first hoist.

7. A method of operating a vehicle having a load-receiving body having a pair of hoists, with each hoist operated by a respective hydraulic fluid operated actuating device and with each hoist being capable of lifting a small container and with both hoists being capable of jointly and cooperatively lifting a large container;

the vehicle including supply means for supplying hydraulic fluid under pressure to the actuating devices and a pair of control valves, one for each hoist, arranged for controlling the supply of hydraulic fluid to the actuating devices;

the method comprising mounting a small container on one of the hoists, opening the control valve which controls that hoist and feeding hydraulic fluid from the supply means to the actuating device of that hoist to raise the hoist until the hoist rises and tips the small container, and then operating said control valve to reverse flow of the hydraulic fluid in the actuating device to lower the hoist and reverse movement of the small container until that container is lowered; and when no small container is mounted on either hoist, mounting a large container on the two hoists so that it can be jointly and cooperatively lifted by said hoists, opening both control valves approximately simultaneously and feeding hydraulic fluid at a relatively high rate via each control valve to a respective actuating device for each hoist to raise the hoist, while the hydraulic fluid flow to one control valve is supplemented at a relatively low rate from the hydraulic fluid flow to the other control valve, to thereby lift both said hoists simultaneously to raise and tip the large container, and subsequently operating the control valves to reverse flow of the hydraulic fluid in the actuating devices to lower the hoists and reverse movement of the large container until that container is lowered.

8. A method according to claim 7 in which:

when the small container is being lifted, diverting hydraulic fluid from the supply means upstream of and around the one open control valve and through the other control valve to a hydraulic fluid reservoir to control the speed at which the small container is lifted.

* * * * *